United States Patent [19]

Zinser, Jr.

[11] Patent Number: 4,776,014

[45] Date of Patent: Oct. 4, 1988

[54] METHOD FOR PITCH-ALIGNED HIGH-FREQUENCY REGENERATION IN RELP VOCODERS

[75] Inventor: Richard L. Zinser, Jr., Schenectady, N.Y.

[73] Assignee: General Electric Company, Schenectady, N.Y.

[21] Appl. No.: 902,987

[22] Filed: Sep. 2, 1986

[51] Int. Cl.[4] ..... G10L 7/02; G10L 9/00

[52] U.S. Cl. ..... 381/38; 381/50; 381/53

[58] Field of Search ..... 381/37, 38, 50, 53; 364/513.5

[56] References Cited

U.S. PATENT DOCUMENTS

| | | | |
|---|---|---|---|
| Re. 32,580 | 1/1988 | Atal et al. | 381/40 |
| 4,220,819 | 9/1980 | Atal | 381/38 |
| 4,301,329 | 11/1981 | Taguchi | 381/37 |
| 4,667,340 | 5/1987 | Aijmand et al. | 381/31 |
| 4,697,261 | 9/1987 | Wang et al. | 381/29 |
| 4,742,550 | 5/1988 | Fette | 381/36 |

OTHER PUBLICATIONS

Viswanathan et al., "Design of a Robust Baseband LPC Coder for Speech Transmission Over 9.6 Kbit/s Noisy Channels", 4/82, pp. 663–673, IEEE Transactions on Communications, vol. COM-30, No. 4.

*Primary Examiner*—Emanuel S. Kemeny
*Assistant Examiner*—C. H. Lynt
*Attorney, Agent, or Firm*—Geoffrey H. Krauss; James C. Davis, Jr.; Marvin Snyder

[57] ABSTRACT

A method for pitch-aligned high frequency regeneration of a speech signal which has been sampled at a known sampling frequency $f_S$ and decimated at a known integer decimation ratio N practiced in the receiver portion of a RELP vocoder includes the steps of: providing at least one local carrier signal(s), (each) at a frequency which is an exact integer multiple of a baseband pitch estimate frequency recovered from received data; amplitude modulating each of the local carrier signals with baseband residual data recovered in the receiver portion to provide partial spectrum data; removing, only if the decimation ratio is even, the lower sideband data from the lowest frequency local carrier signal to obtain partial spectrum data; and adding the residual baseband data to the partial spectrum data to obtain PA-HFRed output data from which to reconstruct the speech signal.

20 Claims, 6 Drawing Sheets

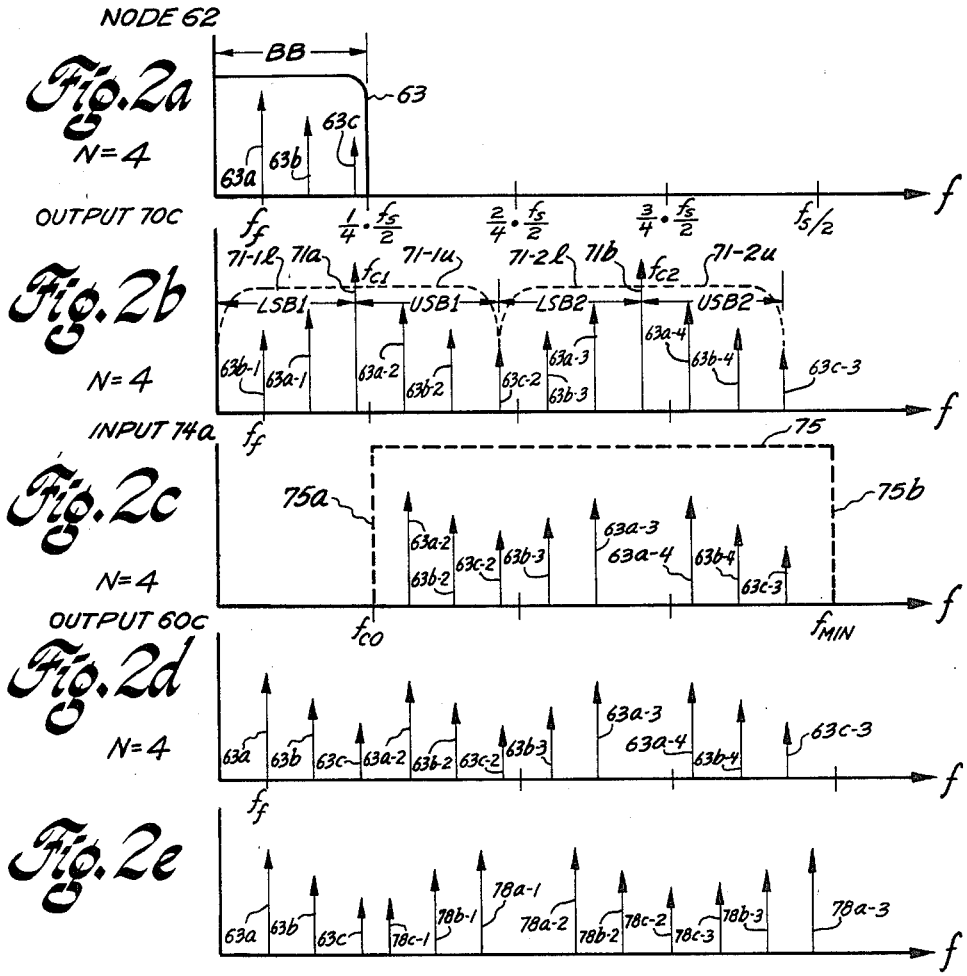
Fig. 2a
Fig. 2b
Fig. 2c
Fig. 2d
Fig. 2e
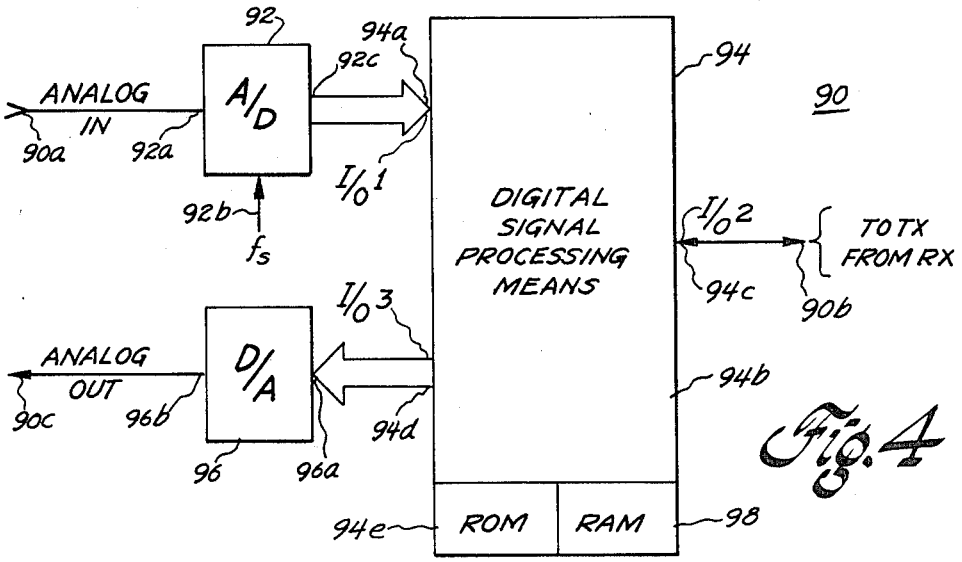
Fig. 4

N=2

N=3

N=5

N=6

METHOD FOR PITCH-ALIGNED HIGH-FREQUENCY REGENERATION IN RELP VOCODERS

BACKGROUND OF THE INVENTION

The present application relates to bandwidth reduction of speech signals and, more particularly, to a residual-excited linear predictive vocoder in which a novel method for pitch-aligned regeneration of high-frequency signal portions reduces the totality of speech quality defects in the reconstituted speech signal.

Present day radio communications requires that minimum bandwidth be utilized for signal transmission. In the transmission of human speech signals, bandwidth compression, by digital encoding and decoding, often utilizes the linear predictive coding (LPC) of speech. One desirable form of the LPC vocoder is the residual-excited type. This residual-excited linear-predictive-coding (RELP) vocoder often suffers from a variety of speech quality defects, with perhaps the most noticeable problem resulting from tonal noises due to the misalignment of pitch harmonics during high frequency regeneration (HFR) in the receiver-decoder. The HFR problem in RELP vocoders has been widely discussed in the literature; many proposed solutions, spanning a large complexity range, have been identified. Simple HFR solution techniques include: (1) spectral folding, or up-sampling, in which the baseband is periodically duplicated in frequency, to produce a total of P copies, where P is an integer decimation ratio, with relatively easy implementation, as only simple up-sampling and no interpolation filter are required; or (2) instantaneous non-linearities, as, for example, produced by rectification and alike. Because of the simple folding aspect of the spectral folding method, the apparent pitch "harmonics" of reconstituted voiced speech do not necessarily fall in a normal harmonic sequence, so that spectral lines and holes appear at improper frequencies and produce annoying tonal noises; this effect is perhaps most pronounced for female speakers. The non-linearity methods, while producing correctly-aligned pitch harmonics, add a somewhat harsh and rough quality to the speech. Both methods result in greatest quality degradation for voiced speech. Of the more complex schemes which have been hitherto designed to alleviate the HFR problem, typical examples are the use of: fast Fourier transformation and pitch detection to transmit a variable-width baseband in order to produce aligned pitch harmonics; fast Fourier transformation and subsequent computation of correlation coefficients between the baseband and high frequency bands for proper high frequency regeneration; or full band pitch prediction, to effectively remove the pitch information before decimation and to restore the pitch information after up-sampling. These, and other, relatively complex methods provide very good recovered speech quality, although such methods require a relatively large amount of digital signal processing speed, memory and other factors, which preclude implementation in a single digital signal processor (DSP) integrated circuit, such as the NEC 7720 or the TI TMS320 integrated circuits and the like. It is therefore highly desirable to provide a relatively low complexity method for providing a true alignment solution to the high frequency regeneration HFR problem, which HFR method can be implemented in a single DSP integrated circuit, preferably in the receiver stage, and preferably without requiring a change in either the vocoder transmitter stage, or in bit rate overhead.

BRIEF DESCRIPTION OF THE INVENTION

In accordance with the invention, my novel method for pitch-aligned high frequency regeneration (PA-HFR) of a speech signal, sampled at a known sampling frequency $f_S$ and decimated at a known integer decimation ratio N, in the receiver portion of a RELP vocoder, includes the steps of: providing at least one local carrier signal, each at a frequency which is an exact integer multiple of a baseband pitch estimate frequency recovered from received data; amplitude modulating each of the local carrier signals with baseband residual data, recovered in the receiver portion, to provide partial spectrum data; removing, only if the decimation ratio is even, the lower sideband data from the lowest frequency local carrier signal to obtain partial spectrum data; and adding the residual baseband data to the partial spectrum data to obtain PA-HFRed output data from which to reconstruct the speech signal.

In my presently preferred method, I prefer to use an even decimation ratio N, particularly N=4, with a sample frequency $f_S$ of about 8 kHz., so that a pair of local carrier signals, at about 1 kHz and about 3 kHz are needed. I especially prefer to digitally process the residual baseband and pitch estimate data in a digital signal processor (DSP), wherein the pair of local carriers are provided by data approximating a substantially square wave signal at the pitch estimate harmonic closest to, but not exceeding, the ($f_S$/2N) frequency.

Accordingly, it is an object of the present invention to provide a novel method for providing pitch-aligned high frequency regeneration of RELP vocoded speech.

This and other objects of the present invention with become apparent upon a reading of the following detailed description, when considered in conjunction with the associated drawings.

BRIEF DESCRIPTION OF THE DRAWINGS

FIGS. 2*a*–2*e* are coordinated frequency distribution graphs illustrating the pitch-alignment method of high frequency regeneration of my invention for the case where the decimation ratio N is predetermined N=4, and of a spectrally-folded form of regeneration, for comparison thereto;

FIG. 4 is a block diagram of one digital signal processing means and associated means for converting analog speech to digital data for transmission, and received digital data to analog speech, in a typical vocoder of a presently preferred embodiment of my invention;

DETAILED DESCRIPTION OF THE INVENTION

Figures 1A, 1B, 1C:
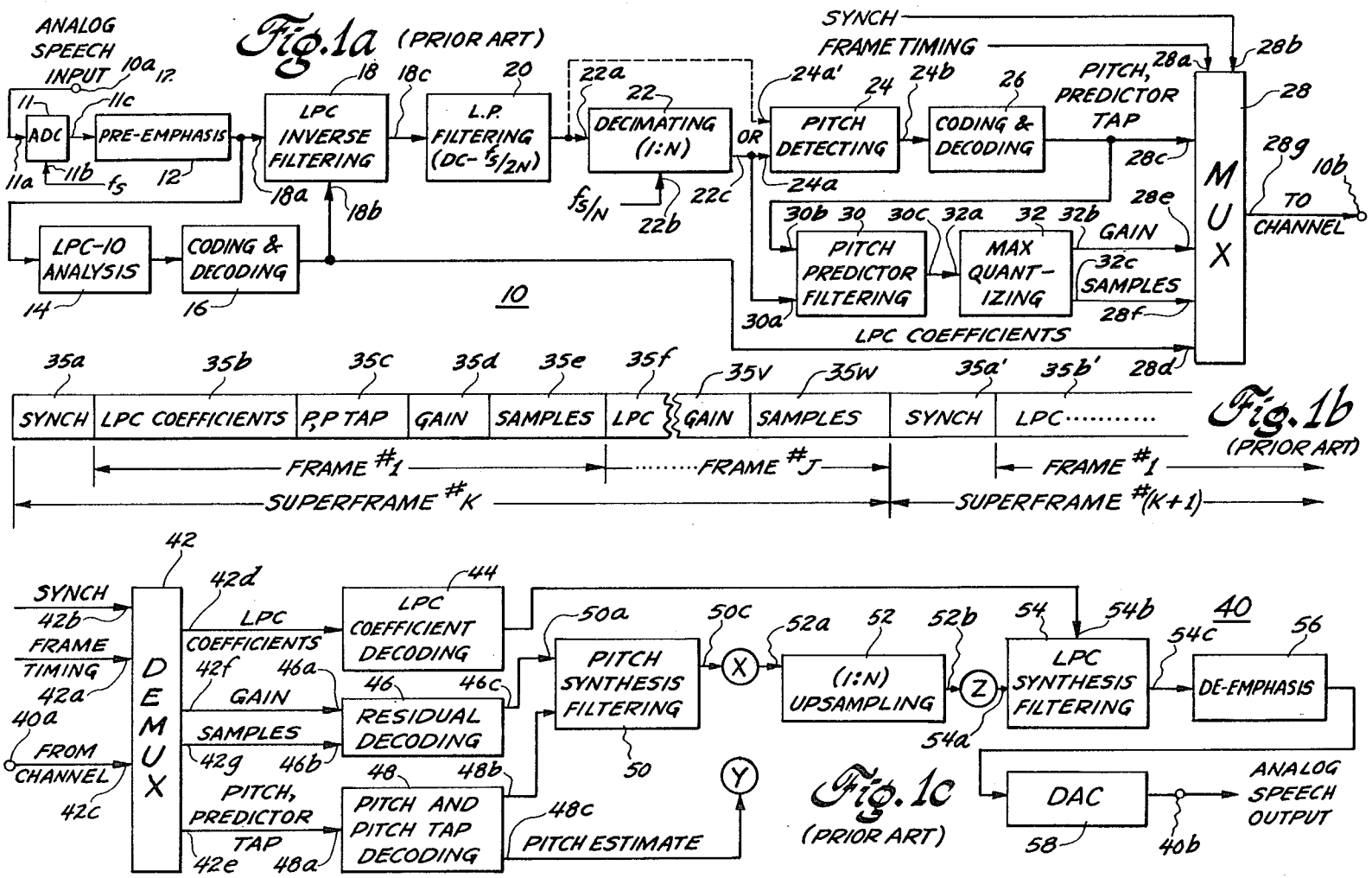
Fig. 1a (PRIOR ART)
Fig. 1b (PRIOR ART)
Fig. 1c (PRIOR ART)
FIGS. 1*a*, 1*b* and 1*c* are respective block diagrams of RELP vocoder transmitter, data channel transmission sequence, and receiver, as known to the prior art, and useful in understanding the environment in which my invention operates.

Referring initially to FIGS. 1*a*, 1*b* and 1*c*, a known residually-excited linear-predictive-coding (RELP) vocoder encoder means 10 and decoder means 40 are respectively shown in FIGS. 1*a* and 1*c*, while the serial data transmission format utilized in the transmission channel therebetween is shown in FIG. 1*b*.

Speech encoding means 10 receives analog input speech signals at an analog speech input 10*a* for coupling to the analog input 11*a* of an analog-to-digital converter (ADC) means 11. ADC means 11 also receives a sampling signal, at a sampling frequency $f_S$, at a sample control input 11*b*. Responsive to each cycle of the sampling signal waveform at input 11*b*, a multi-bit digital data word is provided at ADC means digital output 11*c*, representative of the amplitude of the analog signal at the instant at which the sample was taken. The multiplicity of digital speech samples are digitally pre-emphasized in stage 12. The pre-emphasized data is then coupled to stage 14, wherein the digital speech signal undergoes linear predictive coding analysis in accordance with the well-known LPC-10 protocol. The LPC coefficient data is then properly coded in coding and decoding stage 16. The ADC means output 12*c* data is applied as a first input 16*a* of a LPC inverse filtering stage 18, also receiving the encoded LPC-10 coefficient data as a second input 18*b* for providing at, an output 18*c*, digital data representing a residual signal. After low-pass filtering in a filtering stage 20 (having a cut-off frequency essentially equal to $f_S/2N$, where N is an integer decimation ratio index greater than (1) the low-pass filtered data is then provided as the data input 22*a* of a decimating stage 22. Decimating stage 22 also receives a down-scaled sampling signal, now having a frequency $f_S/N$, as a sampling input 22*b*. Stage 22 thus selects that one of N sequential data words present when the down-scaled sampling signal is received, to provide a decimated digital output signal 22*c*. The filtered data at input 22*a*, or the decimated filtered data at output 22*c*, provides an input signal, as only one of either input 24*a* or input 24*a'* respectively, of a pitch detecting means 24. While the use of the undecimated data, at input 22*a*, will generally provide better operation of a RELP vocoder, an additional $N^2$ computations are required, which additional computations are typically beyond the capacity of most single chip digital signal processor (DSP) integrated circuits presently available. Accordingly, I prefer to perform the pitch detecting operation (typically an autocorrelation operation) upon the decimated data, as shown by the solid connection to the single input 24*a* of the pitch detecting stage 24 to the output 22*c* of the decimating stage. The detected pitch data, from the output 24*b* of the pitch detecting stage, is then coded by coding and decoding means 26, to provide pitch and pitch predictor tap information to one input of a data multiplexer (MUX) stage 28. The decimated data at stage output 22*c* and the encoded pitch, predictor tap information from stage 26 are utilized as first and second inputs 30*a* and 30*b*, respectively, to a pitch predictor filtering stage 30. The output 30*c* data from the pitch predictor filtering stage is applied to the single input 32*a* of a Lloyd-Max quantizing stage 32, providing a first (gain) data output 32*b*, and a second (samples) data output 32. The pitch, predictor tap data, gain data, samples data and LPC coefficient data (from the output of coding and decoding stage 16) are all provided to MUX stage 28, along with frame timing data and synchronization (SYNCH) data, for synthesizing the serial data stream to be provided (at the multiplexer output) to the data transmission channel at RELP encoding means output 10*b*.

For a RELP encoder 10 with a sampling frequency $f_S$ of 8 kHz and a tenth-order LPC computed at 55.5 frames per second with linear quantitization of reflection coefficients with bit allocations 6,5,5,5,4,4,4,3,2,2 and a residual decimation factor N=4 (so that the decimation sample frequency at input 22*b* is 2 kHz.) and with three bits per sample maximum quantitization in stage 32, five bits of data are used to quantize each of the pitch, pitch predictor tap and gain, so that a total system output rate of about 9055 bits per second, exclusive of synchronization, is utilized with 18 frames of data for each data superframe. Thus, any serial data transmission superframe K (FIG. 1*b*) begins with a SYNCH data transmission portion 35*a*, responsive to the frame timing information at MUX input 28*a* and the synchronization SYNCH data at input 28*b*. Thereafter, the first of J sequential frames commence. Each frame begins with a LPC coefficients portion 35*b*, 35*f*, . . . , responsive to the data at MUX input 28*d*. Thereafter, the pitch, predictor tap data portion 35*c*, . . . , responsive to the data at MUX input 28*c*, is transmitted, followed by gain portions 35*d*, 35*v*, ... responsive to the data at MUX input 28*e*, and ending with a samples portion 35*e*, 35*w*, . . . , responsive to the sample data at MUX input 28*f*. The serial transmission of the entirety of the J (here equal to 18) frames of superframe K to MUX output 28, and the encoder output 10*b*, then pass through the transmission channel to the receiver decoder input 40*a* (FIG. 1*c*). Thereafter, the next superframe (K+1) commences with its SYNC portion 35*a'*, followed by the J frames of data thereof.

The receiver decoder means 40 utilizes a demultiplexer DEMUX stage 42, which receives frame timing information at input 42*a* and synchronization information at input 42*b* (which timing and synchronization information can be obtained from the synchronization, or other, portion of the incoming serial data transmission, and also receives the superframe data transmissions from receiver input 40*a* at a demultiplexer data input 42*c*. Responsive to these three inputs, the serial data transmission, received at input 42*c*, is broken into its four separate sequential fields: the LPC coefficients data at a first output 42*d* is connected to a LPC coefficient decoding stage 44; gain data and samples data at respective outputs 42*f* and 42*g* are provided as respective data inputs 46*a* and 46*b* to a residual decoding stage 46; and pitch, predictor tap data at a fourth output 42*e* goes to the signal input 48*a* of a pitch and pitch tap decoding stage 48. The recovered residual data at residual decoding stage output 46*c* is connected as a first data input 50*a* of a pitch synthesis filtering stage 50, receiving its second input 50*b* data from a first output 48*b* of the pitch and pitch tap decoding stage. (Node Y, at which pitch estimate data can be provided by a second output 48*c* of the pitch and pitch tap decoding stage 48, is shown for reference and later use; it is not used in the receiver of this figure.) The output 50*c* of the pitch synthesis filtering stage provides data through a first node X to the input 52*a* of an up-sampling stage 52. The output 52b of the up-sampling stage is provided through a node Z to the first input 54a of a LPC synthesis filtering stage 54, receiving the decoded LPC serial coefficients data at a second input 54b. The synthesized digital speech data is provided at filtering stage output 54c, de-emphasized in means 56 and is converted to analog speech data in digital-to-analog converter (DAC) means 58, to provide a reconstituted analog speech output signal at a receiver output 40b.

Figure 2:
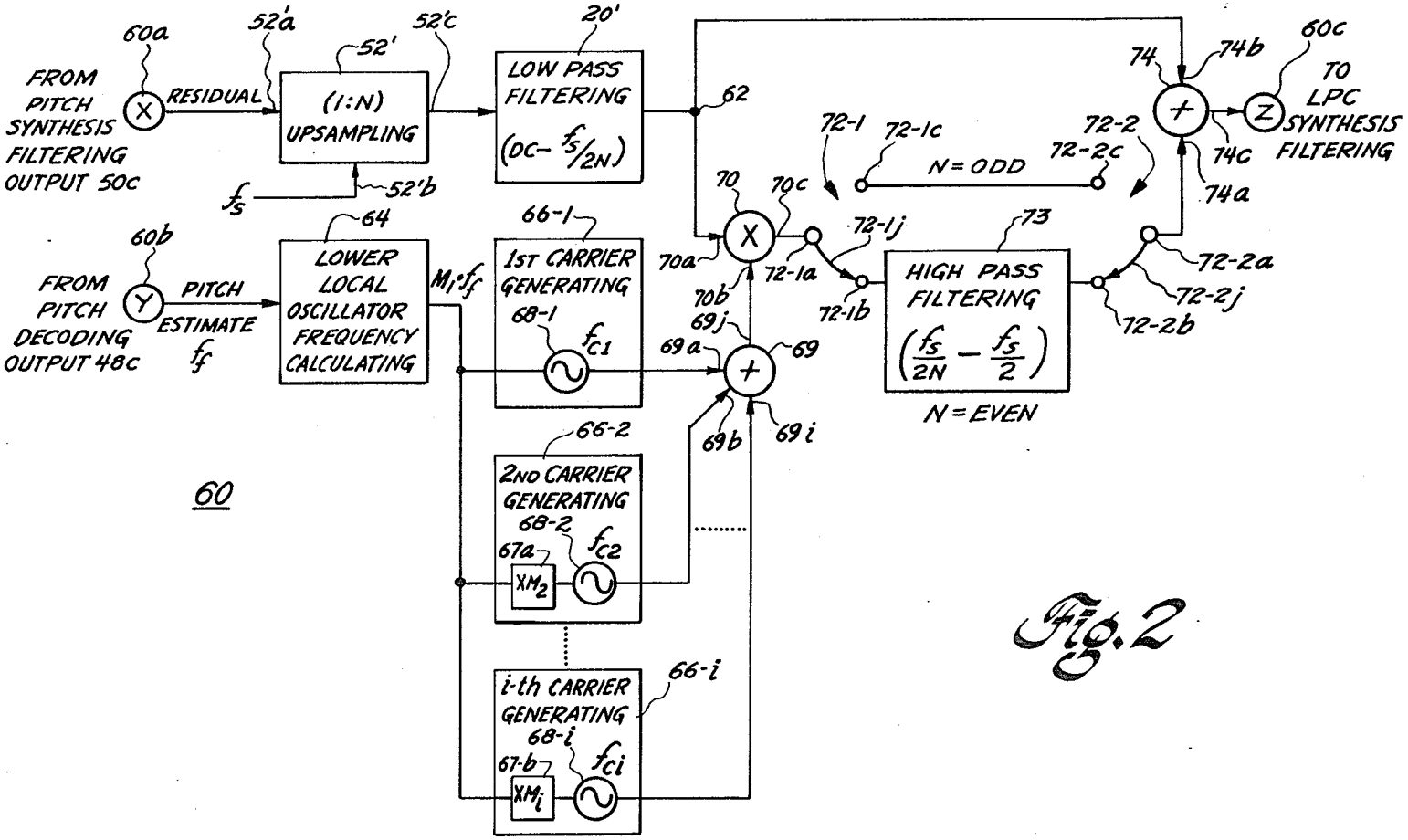
FIG. 2 is a schematic block diagram of the operational stages performed upon the received speech synthesis filtered signal and pitch decoded signal by my novel method, to provide a pitch-aligned high frequency regenerated signal to a subsequent LPC synthesis filtering stage.
Figure 3A:
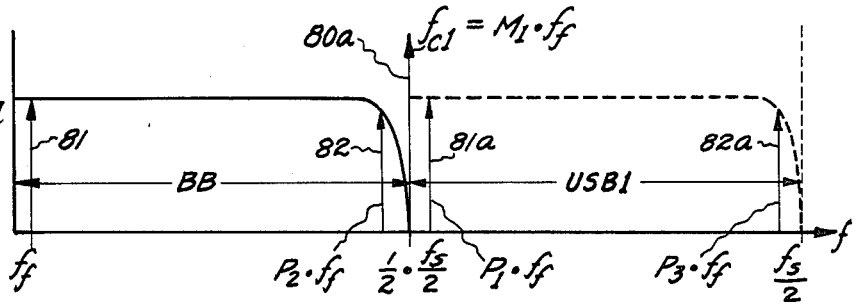
FIGS. 3*a*–3*d* are frequency spectra graphs illustrating my novel method, for other decimation ratio N values between 2 and 6, and useful for further understanding of the novel features of this invention.
Figure 3B:
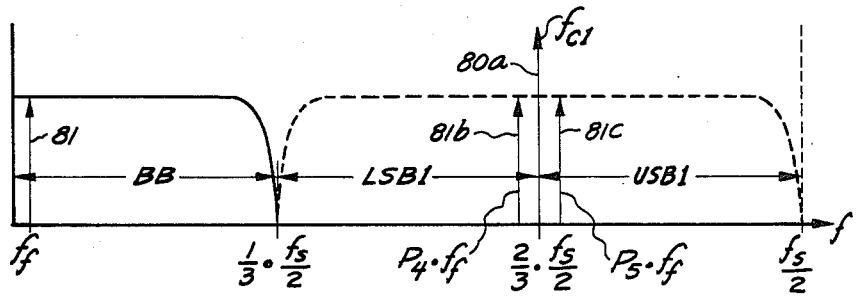
Figure 3C:
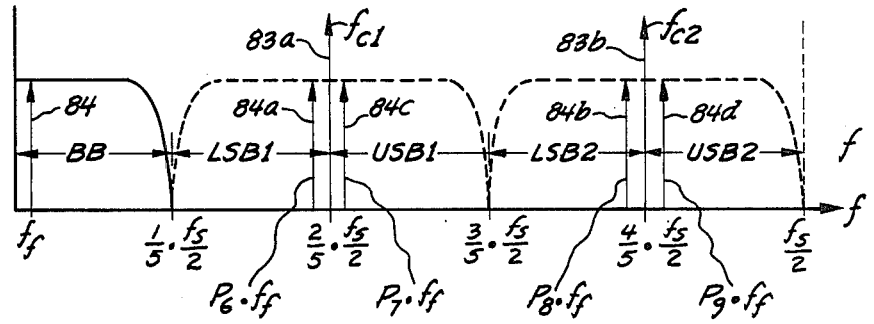
Figure 3D:
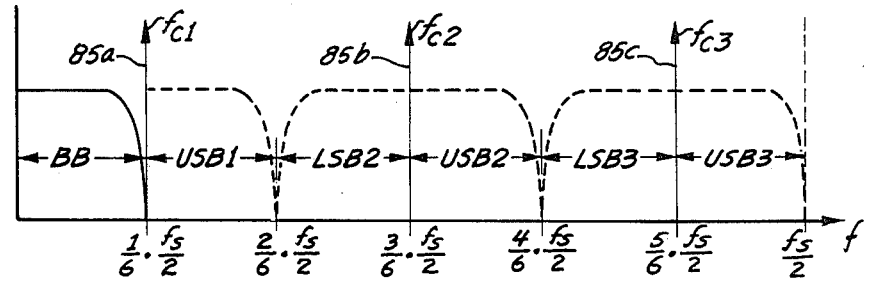

In accordance with the invention, my method for pitch-aligned high-frequency regeneration replaces the up-sampling stage 52 with a pitch alignment section 60 receiving the residual baseband data (at node X from the pitch synthesis filtering output 50c) as a first input 60a data signal and receiving the pitch estimate data (at node Y from pitch decoding output 48c) as a second input 60b data signal. The residual data from input 60a is provided to a first data input 52'a of an up-sampling means 52', having a second input 52'b receiving the sampling signals at frequency $f_S$. Each baseband residual data sample occurs at the lower frequency $f_S/N$ (or 2 kHz., for N=4 and $f_S$=8 kHz., in the illustrated embodiment) is used to provide output 52'c data, which contains N sample data word every $N/f_S$ seconds (or one sample every $1/f_S$, or 125 microseconds) with every set of N=4 successive data samples comprised of the pattern (D,O,O,O) where D is the residual data word data provided at input 52'a for the entire N-sample data interval. The up-sampled baseband residual data is low-pass filtered in stage 20', having substantially the same low-pass filtering function as low-pass filter stage 20, i.e. passing data representative of analog frequencies up to a maximum frequency substantially equal to the sampling frequency divided by twice the decimation factor N (a maximum frequency of $f_S/2N$=1 kHz, for $f_S$=8 kHz. and N=4). The low-pass-filtered up-sampled data is provided to node 62; the frequency spectrum of this signal is limited to the baseband 63, as shown in FIG. 2a, with pitch fundamental 63a and harmonics thereof (e.g. harmonics 63b and 63c) for any one sample.

The baseband is to be frequency translated to the sidebands of an integer number of higher-frequency carriers, each provided by one of at least one local oscillator carrier signal, each of frequency $f_{cn}$ harmonically related to pitch frequency $f_f$; each of the carrier signals is amplitude modulated by the baseband residual data. The pitch frequency $f_f$ estimate data at node Y is the input data provided to a lower local oscillator frequency calculating stage 64. The local oscillator section output is the sum of the carrier signals, each typically of sinusoidal waveshape and having a frequency $f_{ci}$, which are controlled by the transmitter pitch detector to fill the entire recovered audio spectrum with copies of the baseband fundamental pitch. Therefore, each of the at least one carriers are initially set to a preliminary resting frequency which is substantially the 2N-th submultiple of the sample frequency, i.e. about $f_S/2N$, or about 1 kHz. in the present example. The number $n_c$ of carriers to be generated depends upon the compression, or decimation, ratio N, which is dictated by the particular application of the RELP vocoder. This number $n_c$ of carriers, necessary to cause frequency-translated baseband reproductions to fill the whole frequency space, is: $n_c=(N-1)/2$, if N is an odd integer; or $n_c=N/2$, if N is an even integer. The actual frequency of each carrier is perturbed slightly from its nominal resting frequency by the pitch estimate such that the particular carrier frequency $f_{ci}$, where $1 \leqq i \leqq n_c$, will cause alignment of the pitch harmonics when the baseband frequencies are utilized to modulate the entire comb of carriers and generate sidebands; that is, the pitch harmonics in the sidebands will have frequencies exactly at a multiple of the fundamental pitch signal. The approximate frequency $f_{a,i}$ of each of the i possible carriers is given by $$f_{a,i}=(2i/N)(f_S/2)$$

for $1 \leqq i \leqq (N-1)/2$, when N is an odd integer, or by $$f_{a,i}=((2i-1)/N)(f_S/2)$$

for $1 \leqq i \leqq N/2$, when N is an even integer. Thus, in the illustrated example, where N=4, the number of carriers $n_c=(4/2)=2$, and the approximate carrier frequencies are at: $f_{a,1}=f_S/(2N)=f_S/8=1$ kHz and $f_{a,2}=3f_S/8=3$ kHz. The lower local oscillator frequency calculating stage 64 determines the first harmonic multiple $M_1$ of the fundamental pitch frequency $f_f$, so that a first carrier generating state 66-1 has a first carrier, of substantially sinusoidal waveshape, exactly at a frequency $f_{c1}$ which is as close as possible to, without exceeding, the first approximate frequency $f_{a,1}$ The first carrier, produced by an oscillatory stage 68-1, is introduced to a first input 69a of a first arithmetic summing stage 69. Harmonic integer $M_1$ is formed by use of a floor integer function, i.e. $M_1=\lfloor f_{a,1}/f_f \rfloor$, where $f_f$ is the reciprocal of the fundamental frequency pitch time interval; this process is also sometimes referred to as the modulus (MOD) function, as $M_1=(f_{a,1})\mathrm{MOD}(f_f)$, i.e. take the integer portion of the dividend when $f_{a,1}$ is divided by divisor $f_f$, and ignore any remainder. Additional carrier generating stages 66-2, . . . **66-*i* must provide each higher-frequency carrier, of frequency $f_{c2}$, . . . ,$f_{ci}$, from an associated oscillatory stage 68-2, . . . ,68-*i*, at a further integer multiple $M_2$, . . . ,$M_i$ of the first carrier exact frequency. Thus, multiplier stage 67a multiplies the first exact frequency $f_{c1}$ data by a constant integer $M_2$ to control a second exact oscillatory stage 68-2 to provide the second carrier exact frequency $f_{c2}$ to a second input 69b of the additive stage 69. Dependent on the decimation ratio N, j total carrier generating stages are required, with the i-th carrier generating stage 66-*i* (where $1 \leqq i \leqq j$) having a i-th multiplying stage 67b, for multiplying the original harmonic data by the i-th multiplier $M_i$ to control the i-th actual frequency $f_{ci}$ of the i-th oscillatory stage 68-i, providing its data to the i-th input 69*i* of adder means 69. That is, for an even upsampling ratio N, the multiples M=3,5,7, . . . , and for an odd ratio N, the multiples M=2,3,4, . . . . The adder means output 69*j* thus provides a comb of carriers, being $n_c$ in number, and being each locked to an integer harmonic of the fundamental pitch estimate frequency $f_f$. This frequency comb data is provided to one input 70b of a multiplier (mixer or modulator) stage 70, receiving at a baseband data input 70a the low-pass filtered baseband data from node 62. Each carrier in the carrier comb is modulated by the baseband data, so that a comb of modulated carrier data words are provided at modulator output 70c. These data words have a frequency spectrum as shown in FIG. 2b, for the N=4 case. The first or second carrier 71a or 71b is enclosed by the lower and upper modulation sidebands 71-11 and 71-1*a* or 71-21 and 71-2*u*, respectively. Pitch fundamental 63a has been frequency-translated to spectral components 63*a*-1, 63*a*-2, 63*a*-3 and 63*a*-4, while pitch harmonic 63b has been translated to components 63*b*-1, 63*b*-2, 63*b*-3 and 63*b*-4 and harmonic 63c** has been translated to component 63c-2 and 63c-3; all of these components are of integer harmonic relationship to pitch frequency $f_f$. This stream of data words is coupled through first and second selection stages 72-1 and 72-2, which selectively insert a high-pass filtering stage 73 only for even decimation ratios N, prior to the modulated comb data appearing at a first input 74a of a second arithmetic addition stage 74, receiving the low-pass filter baseband data at a second input 74b. No high-pass filtering stage 73 is necessary if the decimation ratio N is an odd integer, in which case the data at first selection stage input 72-1a is connected through node 72-1c, to node 72-2c and thence to node 72-2a at the input 74a. If the decimation ratio is even, the high-pass filter, having a lower cut-off frequency of about $f_S/2N$ (and passing frequency data up to at least the higher frequency of $f_S/2$), operates upon the modulated carrier comb by passage of data at node 72-1 through. the jumper 72-1j connection to node 72-1b, filtering in stage 73 and connection of filtering output node 72-2b through connection 72-2j jumper to the 72-2a node.

For either case, the spectrum 75 in FIG. 2c exists only above the cutoff frequency line 75a and below the half-sampling frequency line 75b. If balanced modulation is used, then each carrier frequency 71a or 71b (at $f_{c1}$ and $f_{c2}$) is nulled, and spectrum 75 contains only the modulation sideband harmonics 63a-2, 63a-3, 63a-4, 63b-2, 63b-3, 63b-4, 63c-2 and 63c-3. The data stream at input 74a is thus devoid of the original residual baseband data, although it contains the sideband of each of the at least one carriers having the baseband data modulator thereon, except in the even N situation, where the lowest-frequency carrier only has baseband data in the upper sideband thereof. The lower sideband of the lowest-frequency carrier, at frequency $f_{c1}$, is the original baseband data at input 74b, which is added to the data at input 74a, to provide the pitch-aligned high-frequency regenerated data for the original frequency span, shown in FIG. 2d at the node Z output 60c, for introduction to the input of the LPC synthesis frequency stage.

Referring to FIG. 2e, the spectrum of the baseband pitch fundamental 63a and harmonics 63b and 63c has been folded, by one of the prior art methods, so that folded pitch frequencies 78a-1, 78a-2 and 78a-3 exist, as well as folded frequencies 78b-1, 78b-2, 78b-3, 78c-1, 78c-2 and 78c-3. Comparing the non-harmonic relationship of any of the folded components 78 with a truly-harmonic component 63 illustrates the lack of pitch alignment responsible for determining tonal noise in these forms of prior art HFR methods.

Referring now to FIGS. 3a–3d, the frequency spectrums, corresponding to output 60c data, for decimation ratios N=2, 3, 5 and 6 are shown. As predicted by the design equations set forth hereinabove, the spectra for N=2 and N=3 require the generation of only a single carrier, at a frequency $f_{c1}$, which is near to, but not greater than, the approximate frequency $f_{a,1}$, of ($f_S/4$) or ($f_S/3$), respectively. If N=2, the fundamental pitch component 81, at frequency $f_f$, is translated to the upper sideband component 81a, at a frequency equal to a harmonic pitch integer $P_1$ times the fundamental frequency, while a baseband harmonic 82 having a pitch harmonic integer multiple $P_2$, translates to an upper sideband pitch harmonic 82a, at a pitch integer multiple $P_3$ of the fundamental frequency. In the N=3 case, the fundamental frequency component 81 translates to a lower sideband component 81b, at a pitch harmonic $P_4$, and also to an upper sideband component 81c, at a pitch harmonic $P_5$; the remainder of the pitch harmonics in the baseband BB frequency spectrum also translate into lower and sideband components. For the N=5 case, requiring a pair of carriers 83a and 83b, the baseband (BB) fundamental pitch component 84 translates to lower sideband components 84a and 84b, at pitch harmonics $P_6$ and $P_8$, respectively, and to upper sideband components 84c and 84d, at respective pitch harmonics $P_7$ and $P_9$, respectively. The N=6 case requires three carriers 85a, 85b and 85c, each having an upper sideband containing pitch-harmonic components, but with only the higher pair of carriers have lower sidebands with pitch-harmonic components.

Referring now to FIG. 4, I prefer to implement my RELP encoder/decoder, with pitch-aligned high frequency regeneration, by utilization of hardware means 90, which receives the analog input signal at an input terminal 90a, for generating a serial digital data stream at a port 90b to a transmitter, typically having at least one electromagnetic carrier, and receiving data thereat from a receiver, for providing a decoded analog signal at an output port 90c. The incoming analog signal is applied to the analog input 92a of an analog-to-digital (A/D) converter means 92, receiving periodic sampling signals, at a sampling frequency $f_S$, at its sampling input 92c, for providing data samples at a data output 92c. The data samples are applied to a first data input-output (I/O 1) port 94a of a digital signal processing means 94. The digital signal processing means typically comprises a digital signal processor (DSP) 94b, such as a Texas Instrument TMS 320 series DSP and the like. The DSP has a second input-output port (I/O 2) 94c for providing the serial data stream to port 90 and for receiving the received data stream therefrom. A third input-output port (I/O 3) 94d provides the decoded digital data to the digital input 96d of a digital-to-analog (D/A) converter means 96, providing a received analog signal at its output 96b, for conveyance to the analog output terminal 90c. DSP 94b operates under control of a fixed program stored in read only memory (ROM) means 94e, which may be internal to the DSP, as in the aforementioned TMS320 integrated circuit and the like, and utilizes associated random-access memory (RAM) means 98. In my presently preferred half-duplex RELP processor system, a single TMS320 processor is utilized, with RAM means 98 comprised of 256 words of 16-bit external buffer/temporary storage memory, and with all of the combined transmitter and receiver program code containable within the on-chip memory.

Figure 4A:
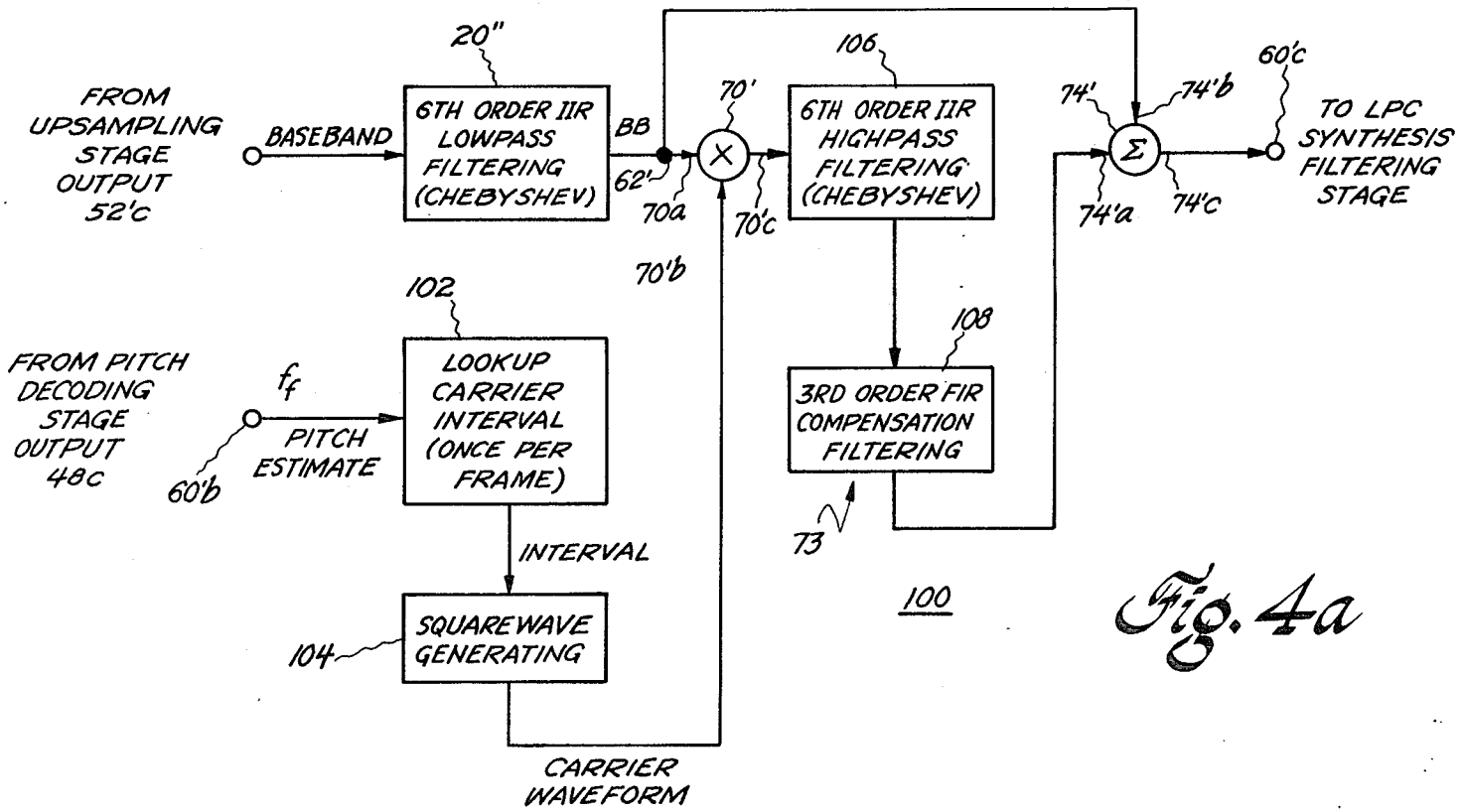
FIG. 4*a* is a block diagram of the stages of one presently-preferred embodiment of my novel method for a N=4 design.
Figure 4B:
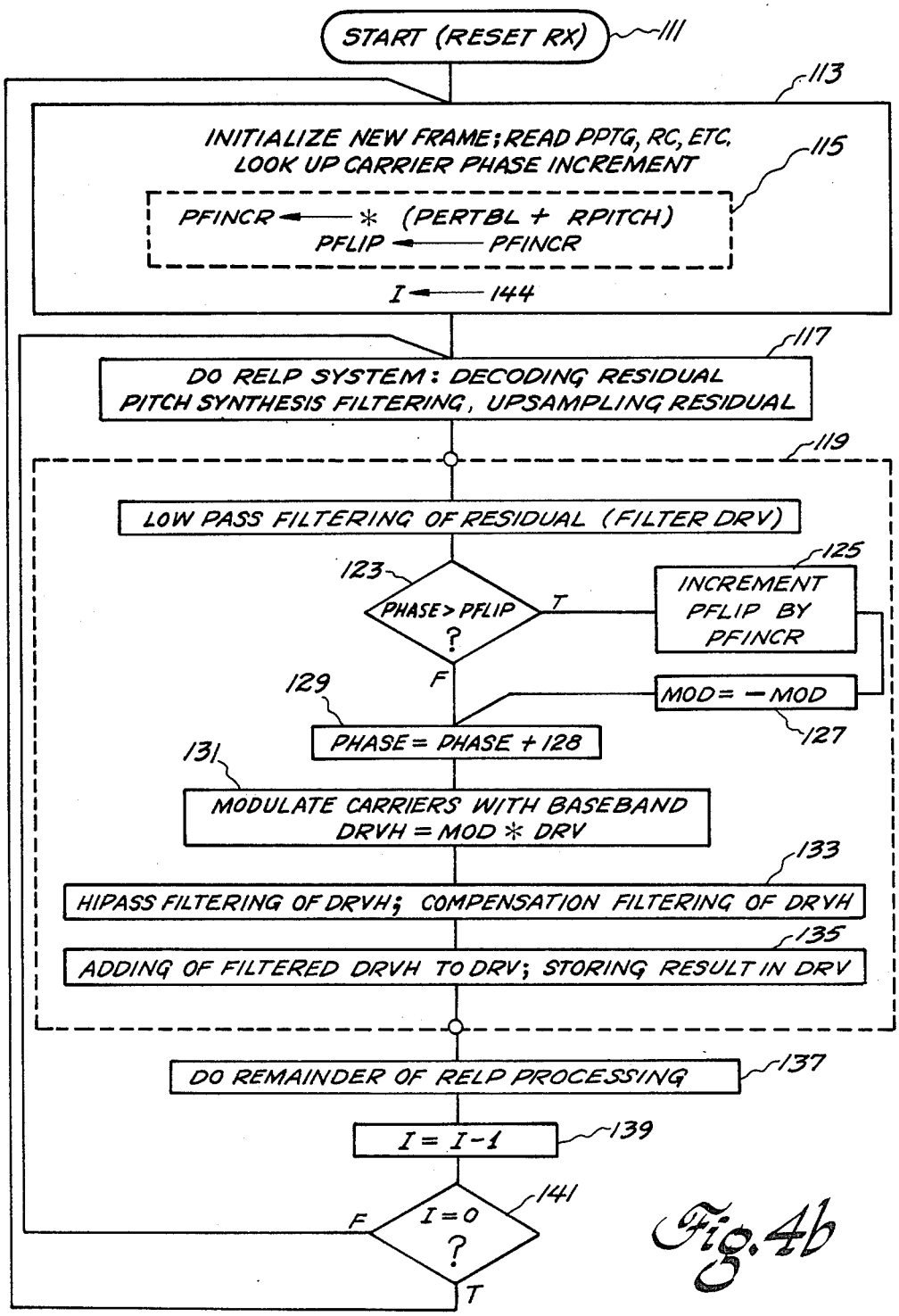
FIG. 4*b* is a logic flow chart for the operations of the embodiment of FIG. 4*a*.

Prior to discussing the digital data flow of FIG. 4b (for a preferred, and somewhat modified, stage flow, as shown in FIG. 4a), some additional considerations in the design of my novel pitch-aligned high frequency regeneration method for RELP vocoders must be discussed: recapitulating some previously discussed points of my invention, even decimation ratios N will result in spectral inversion of the baseband signals so that the regenerated signal must be passed through a high-pass filter to remove the inverted-frequency (lower sideband) portion associated with the first carrier. The original and non-inverted baseband signal is then added back in to arrive at the final spectral data. It is evident that no high-pass filtering is required if an odd decimation ratio N is utilized; the baseband portion is added directly to the modulated carrier signal, as the translated modulated carriers do not overlap the baseband signal. It would thus appear that use of an odd decimation ratio N should be preferable; however, if an odd decimation ratio is chosen, the pitch estimate is insufficient if derived from decimated residual data fed to pitch detecting stage 24 of the transmitter/encoder. That is, use of a pitch estimate drawn from the undecimated sample, by connection of alternate input 24a' to decimating stage input 22a, would allow an odd decimation ratio to be utilized, as this pitch estimate has the maximum possible resolution, given the sampling rate $f_S$. As previously stated, this use of undecimated samples to generate the pitch estimate requires an additional $N^2$ computations, which cannot be realized at the required speed with presently-available DSPs, so that pitch estimation from the decimated residual must presently be used. Therefore, the pitch resolution is reduced by a factor of N, in a practical situation. If the decimation ratio is odd where, as here, the pitch detector operates on decimated data, presently available oscillator frequency selection methods will always yield the same oscillator frequency, no matter what fundamental pitch frequency $f_f$ is detected. This occurs because the required oscillator frequency is always an integer multiple of any detected pitch fundamental. In other terms, the pitch period output, measured in sampling intervals at the undecimated rate, are evenly divisible by decimation factor N. The regenerated spectrum in these cases would be exactly the same as the spectra generated by simple spectral folding, with no benefit from pitch alignment. Therefore, for odd decimation ratios, using a pitch detector on the decimated data is relatively ineffective. Conversely, where the pitch detector operates on decimated residual data and the decimation ratio N is even, the lowest oscillator frequency is at the top of the baseband and is not necessarily an integer multiple of the possible pitch detector outputs. For an even value of N, the pitch detector is only capable of detecting fundamentals that will fall in natural alignment when simple spectral folding is used. Although this may appear to negate any improvement, enhancement of output sound quality occurs because the pitch harmonics will fall closer to the two locations (although not precisely thereat) and reduce the frequency of any beat notes to make these beat notes less obvious. The ability to use a pitch detector on decimated data is an important factor in real-time implementation, as considerably less processor time and memory are required relative to pitch detector of undecimated data. Accordingly, an even decimation ratio system is preferred, e.g. N=4, as illustrated.

Referring now to FIG. 4a, the actual pitch-alignment high frequency regenerator 100 (utilized with up-sampling stage 52' shown in FIG. 2) is illustrated. The up-sampled baseband residual data is subjected to a sixth order infinite-impulse-response (IIR) lowpass filtering stage 20'', utilizing a Chebyshev low pass function, to derive the filtered residual baseband (BB) data at node 62' (and therefore at first multiplier input 70'a and second summer input 74'b). In accordance with another aspect of my novel method, by selecting N=4, wherein two carriers are required to be in a 1:3 harmonic carrier frequency relationship, the carrier waveform is approximated by a square wave at the lower carrier frequency, i.e. having the greater carrier time interval, or period. Thus, input 60b receives the pitch estimating stage output 48c data for estimating the fundamental pitch frequency $f_f$ to the input of a look up carrier period stage 102, which consults a look-up table to generate the durational interval for a waveform which approximates a square wave, having the fundamental pitch frequency time period, once each frame (since the pitch estimate data is actually transmitted, and can therefore only change, at most, only once per frame). The interval data from stage 102 is utilized by a square wave generating stage 104 to provide the carrier waveform data to multiplier second input 70'd. Thus, while a pitch detector operating on undecimated data (e.g. at a 8 kHz. rate) normally requires buffers large enough to exhaust the memory of an entire digital signal processor, use of an even decimation ratio (N=4) in this system makes it possible to use a pitch detector on the decimated residual so that, for an 80–250 Hz. range of fundamental frequency, the pitch detector requires only 18 autocorrelation product computations and 25 storage locations for input lag storage. Therefore, it is possible to locate the pitch detector in the receiver, if there are not enough data processing resources available in the transmitter. With odd-order harmonics absent, for a ratio N=4, the lower carrier frequency $f_{c1}$ signal can be given a pseudo-square waveshape and have a harmonic component at $3 \cdot f_{c1} = f_{c2}$. This generates both carriers with the proper 1:3 harmonic ratio, although the third harmonic signal component has a somewhat lower amplitude then desired. Accordingly, a compensating filter stage is required to correct for the lower amplitude of the third harmonic signal, so that this method generates a viable waveform. Therefore, the multiplied signal data, at multiplier output 70'c, is first high-pass filtered with a sixth order IIR high pass filtering stage 106, having a Chebyshev response, and is then compensated by the use of a third order compensation filtering stage 108, having a finite-impulse-response (FIR). The filtered data is provided to the first input 70'a of the output summer stage 74' wherein the low-pass-filtered baseband BB residual data is added to the high-pass-filtered modulated comb, such that the data at output 60c' has the desired frequency spectrum, i.e. a spectrum similar to that of FIG. 2d.

The actual digital signal processing for the aforementioned TMS32010 DSP is in accordance with the flow chart of FIG. 4b. The sequence starts in step 111, wherein the receiver is reset. The program passes to step 113, wherein: the various registers are initialized to contain new frame information; new PPTG (pitch predictor tap gain), RC (reflection coefficients in LPC model) and similar information is read; and the next carrier phase increment is obtained from its look-up table. As part of program step 113, a substep 115, particularly utilized as part of my novel pitch-align high frequency regeneration technique, uses the assigned variables PFINCR, at an assigned RAM memory location of $11 (where $ identifies a hexidecimal location) to store the increment to add to define the next zero crossing of the fundamental carrier (which next zero crossing phase point is the PFLIP variable stored at location $12); RPITCH, at memory location $18, in which is stored the decoded raw reversed pitch data; and PERTBL, an assembler symbol equated to value $57A, as the ROM base offset at which is located the start of a table defining the half period of the carrier frequency. A constant ONE (=1) is stord at location $2A. In this program substep 115, the TMS-32010 code used is:

| | | |
|---|---|---|
| LAC | RPITCH | Lookup ½ period of carrier |
| LT | ONE | Use reversed pitch tbl |
| MPYK | PERTBL | PERTBL is EQU to ROM address of table |
| APAC | | Add pitch to get table offset |

-continued

| | | |
|---|---|---|
| TBLR | PFINCR | Read in period in 128*discrete time |
| DMOV | PFINCR | Init PFLIP ≦ − PFINCR (adjacent in memory) |

and the carrier generation table (at ROM location $57A) for looking up the one-half period of the carrier frequency, is coded with address-reversed lookup, so as to utilize the eighteen sequential data values

| | |
|---|---|
| DATA | 533,512,535,512,538,512,540,512 |
| DATA | 544,512,549,512,555,512,563,512 |
| DATA | 576,512. |

The entries in this table have been scaled by 128 to provide more accuracy for non-integer periods. The contents of the memory location pointed to by the decoded pitch value, added to the table base offset PERTBL value, is placed into the PFINCR variable location. This variable value is subsequently loaded into the PFLIP variable location, $12, which sets the phase point for the next zero crossing. Thereafter, the value I is set equal to a predetermined integer (e.g. 144) and step 113 is exited. Step 117 is now entered and all of the normal RELP system tasks, prior to pitch-aligned high-frequency regeneration, are completed, including the steps of: decoding the residual data; performing the pitch synthesis filtering of the decoded residual; upsampling the filtered residual data by upsampling ratio N; and the like.

The pitch-aligned high-frequency regeneration portion 119 of the program is now entered. In the first PA-HFR program step 121 the previously-generated upsampled residual data is low pass filtered, utilizing a sixth order Chebyshev low pass filter. The low pass filter, and subsequent high pass filter, tap information is stored in memory as follows:

| | | |
|---|---|---|
| AL12, mem. loc. | $30 | Start of LPF |
| BL30, | $3B | End of LPF |
| AH12, | $3C | Start of HPF |
| BH30, | $47 | End of HPF |
| TRL4 | $48 | LPF state buffer |
| ZL12 | $50 | + temps |
| TRH4 | $51 | HPF state buffer |
| ZH12 | $59 | + temps |

and utilized in a low pass-filter program code portion:

| | | |
|---|---|---|
| LARK | 0,ZL12 | set up addresses for taps and |
| LARK | 1,AL12 | state buffers |
| LAC | DRV,12 | input is DRV |
| CALL | FILT2 | |
| CALL | FILT2 | 3-2nd order filter sections |
| CALL | FILT2 | |
| SACH | DRV,4 | store output in DRV |

to provide the lowpass-filtered residual data which modulates the local carriers.

In the next portion of the PA-HFR code, in test step 123 and steps 125, 127 and/or 129, the PHASE portion of memory acts as a counter for the square wave period. The high frequency (e.g. 1000 Hz.) square waveform signal is attained with correct accuracy by coding one sample period as 128 decimal. This coding is used because of the short, non-integer sample periods (e.g. 4.16, 4.18, etc.) required near 1000 Hz. Although the individual zero crossings will not be exact at every period, the average zero crossing rate will be correct over a frame. It has been noted that the period table (PERTBL) data is also encoded in this fashion. In test step 123, the value in the square wave counter PHASE is compared to the value of the next zero crossing phase point, in PFLIP, by utilizing the code

| | | |
|---|---|---|
| LAC | PHASE | Load PHASE counter; test if a |
| SUB | PFLIP | half period has elapsed. If so, |
| BLZ | NOFLIP | increment PFLIP to the point of next zero crossing. |

If this test returns a "true" value, step 125 is entered, wherein the data in PFLIP is incremented by the value in PFINCR and the sign of the carrier waveform (MOD) is inverted, utilizing the code:

| | | |
|---|---|---|
| LAC | PFLIP | Increment PFLIP TO next flip point |
| ADD | PFINCR | |
| SACL | | |
| PFLIP | | |
| ZAC | | Flip the sign of the carrier waveform (MOD) |
| SUB | MOD | |
| SACL | MOD. | |

It should be noted that the MOD data is the present carrier waveform sample value. This value is initially set to +2, and then alternates between +2 and −2 while the program is running. (Other values can be utilized, depending upon the desired high frequency boost.) It should also be understood that: the square waveform carrier period is generated based upon the pitch period and, as previously stated, that the pitch table is itself set up to save memory space by utilizing reverse direction addressing, with a code of 25-LAG (i.e. reverse addressing); the low pass and intermediate residual data DRV is assigned a RAM memory location at $0B; the HFR square wave carrier signal data MOD is stored at location $0E; and the square waveform signal phase counter data PHASE is stored at memory location $10.

If either the result of test step 123 was "false" (F), or the step 123 result was "true" (T) and steps 125 and 127 have been completed, program step 129 is now entered and the square wave signal phase counter data is incremented by a decimal 128 value, utilizing the code:

| | | | |
|---|---|---|---|
| NOFLIP | LACK | 128 | Increment phase |
| | ADD | PHASE | Scaling--1 sample = 128 phase units. |
| | SACL | PHASE | |

The now-updated square waveform provides the necessary first and third carriers, which is subsequently modulated with the baseband information in step 131, wherein the HFR square wave carrier is multiplied by the intermediate residual data DRV and the result placed into the high-frequency regenerated residual sample data DRVH data location at $79 of the random access memory. This is carried out utilizing the code.

| | | |
|---|---|---|
| LT | MOD | Mix (modulate) up the baseband |
| MPY | DRV | |
| PAC | | |

-continued

| | | |
|---|---|---|
| SACL | DRVH | Store modulated baseband in DRVH |

The modulated carriers are now high pass and compensation filtered in program step 133, utilizing the high pass filter code:

| | | |
|---|---|---|
| LARK | 0,ZH12 | set up addresses for taps and |
| LARK | 1,AH12 | state buffers |
| LAC | DRVH,12 | input is DRVH |
| CALL | FILT2 | |
| CALL | FILT2 | 3-2nd order filter sections |
| CALL | FILT2 | |
| SACH | DRVH,4 | store output in DRVH |

and then providing the third order FIR compensation filter, (with a one sample delay) for compensating for the lower amplitude of the 3 kHz. harmonic, utilizing the code:

| | | |
|---|---|---|
| LAC | ZH1,12 | Add in delay-1 sample to give a preselected gain, filtered transfer. |
| LT | ZH2 | |
| MPYK | −1024 | |
| LTD | ZH1 | |
| MPYK | 2048 | |
| LTD | DRVH | |
| MPYK | −1024 | |
| APAC | | |

The final step 135 of the pitch-aligned, high-frequency regeneration code adds the baseband data DRV back to the now-filtered data for the modulated carriers (which data was left in the accumulator), and then stores the final data result back in the DRV register. This is carried out utilizing the two code statements:

| | | |
|---|---|---|
| ADD | DRV,12 | Add in baseband |
| SACH | DRV,4 | Store output in DRV for input to synth filter. |

It should be understood that the example support subroutines and ROM memory constant tables shown in addendum 2 can be utilized with the above code.

Thereafter, step 137 is entered, wherein the remainder of the RELP processing (the LPC synthesis filtering, de-emphasis and the like steps) is performed, prior to the digital-to-analog conversion of the data into the analog speech output signal (to be provided at receiver output **40*b*). Thereafter, the value of i is decremented, in step 149, and the value of i is tested, in test step 141, to determine if the frame has ended. If the frame has not ended, step 141 exits to step 117; if the frame is over, step 141 exits to step 113**, wherein the new frame is initialized and the RELP processing, with pitch-aligned high frequency regeneration, is again carried out.

I have implemented three systems upon a non-real-time microcomputer for listening tests: a full-complexity version, using TMS32010 parameters; a reduced-complexity (square wave carrier) version utilizing TMS32010 parameters; and a RELP system with full band pitch prediction. Thus, a full band pitch prediction RELP system was compared to pitch-aligned, high-frequency regenerated RELP systems utilizing both (a) an undecimated pitch detector and pure sine wave form signals, and (b) a decimated pitch detector and square wave modulation. Listening tests found that all three systems produced approximately the same level of tonal noise rejection, with the most noticeable noise rejection occurring for female voices. Very close quality of reproduced speech was obtained in the full band-pitch-prediction RELP system and the full-complexity PA-HFR RELP system, with the reduced-complexity system providing a relatively small additional amount of speech roughness which is most pronounced in male speakers, due to the compromises selected to allow a single digital speech microprocessor to be utilized. The sinusoidal carrier waveform/undecimated pitch detector system would probably require a total of two or three TMS 320 DSPs (while the full band-pitch-prediction RELP system requires six NEC7720 processes) to provide the lesser roughness quality for male speakers.

While one presently preferred embodiment of my novel method for pitch-aligned high-frequency regeneration RELP vocoders is described in detail herein, many modifications and variations will now become apparent to those skilled in the art. It is my intent, therefore, to be limited only by the scope of the impending claims and not by the specific details or instrumentalities presented by way of description and explanation of the preferred embodiments herein.

ADDENDUM I TO SPECIFICATION - RD-16,343

OBJECT CODE

| ADDRESS Base | Increment 0 | 1 | 2 | 3 | 4 | 5 | 6 | 7 | 8 | 9 | A | B | C | D | E | F |
|---|---|---|---|---|---|---|---|---|---|---|---|---|---|---|---|---|
| 0 0 0 0 | 2018 | 6A2A | 857A | 7F8F | 6711 | 6911 | 7050 | 7130 | 2C0B | F800 | 0035 | F800 | 0035 | F800 | 0035 | 5C0B |
| 0 0 1 0 | 2010 | 1012 | FA00 | 001A | 2012 | 0011 | 5012 | 7F89 | 100E | 500E | 7E80 | 0010 | 5010 | 6A0E | 6D0B | 7F8E |
| 0 0 2 0 | 5079 | 7059 | 713C | 2C79 | F800 | 0035 | F800 | 0035 | F800 | 0035 | 5C79 | 2C7A | 6A7B | 9C00 | 6B7A | 8800 |
| 0 0 3 0 | 6B79 | 9C00 | 7F8F | 0C0B | 5C0B | 6A91 | 6DA0 | 6C91 | 6DA0 | 7F8F | 5D00 | 003D | 0C2A | 5CA8 | 7F89 | 68A1 |
| 0 0 4 0 | 6DA0 | 6C98 | 6991 | 6D80 | 6B91 | 6DA0 | 7F8F | 7F8D | 057A | 0215 | 0200 | 0217 | 0200 | 021A | 0200 | 021C |
| 0 0 5 0 | 0200 | 0220 | 0200 | 0225 | 0200 | 022B | 0200 | 0233 | 0200 | 0240 | 0200 | 058C | F387 | 1547 | F7A5 | 07C4 |
| 0 0 6 0 | 07C4 | F979 | 0F74 | FD2F | 0500 | FDCD | 0AA7 | 02F2 | 0266 | 0598 | F3DE | 1300 | F034 | 0986 | F8F9 | 1101 |
| 0 0 7 0 | EB52 | 0B6E | FB65 | 109D | E8C9 | 0BC4 | FB0E | | | | | | | | | |

ADDENDUM 2 to SPECIFICATION-RD-16,343

```
Filter subroutine: FILT2
          order callable IIR filter structure
coefficient scaling: 1.000 = 4096
NOTE: Taps B0,B2 assumed equal (best phase design);
      stored in B0.  Scaling is now explicitly
included in each section. (scale B0,B1,B2 by
1/gain for that section)
      Subroutine: mem=19 , cy=21
FILT2   LT      *-,1        Z2
        MPY     *+,0        A2
        LTA     *-,1        Z1
        MPY     *+,0        A1
        APAC
        BGEZ    OKAYF
        ADD     ONE,12
OKAYF   SACH    *+,4        TEMP
        ZAC
        MAR     *+,1        MOVE ARO TO Z2
        MPY     *+,0        Z1*B1
        LTA     *-          T <- Z2; ARO AT Z1
        DMOV    *-,1        Z1 -> Z2; ARO AT TEMP
        MPY     *,0         B0*Z2
        LTD     *-,1        T <- TEMP ; ARO TO NEXT SECTION
        MPY     *+,0        B0*TEMP
        APAC
        RET
Low pass filter (0-1kHz) coefficients
      Chebyshev design - 6th order; Scaling - 4096=1.000
      AORG    >58C
      DATA    -3193       A12
      DATA    5447        A11
      DATA    -2139       B11
      DATA    1988        B10
      DATA    -1671       A22
      DATA    3956        A21
      DATA    -721        B21
      DATA    1280        B20
      DATA    -563        A32
      DATA    2727        A31
      DATA    754         B31
      DATA    614         B30
High pass filter (1-4kHz) coefficients
      Chebychev design - 6th order
      Scaling - 4096=1.000
      AORG    >598
      DATA    -3106       A12
      DATA    4864        A11
      DATA    -4044       B11
      DATA    2438        B10
      DATA    -1799       A22
      DATA    4353        A21
      DATA    -5294       B21
      DATA    2926        B20
      DATA    -1179       A32
      DATA    4253        A31
      DATA    -5943       B31
      DATA    3012        B30
```

What I claim is:

1. A method for the pitch-aligned high-frequency regeneration (PA-HFR) of a speech signal, decimated at a known decimation ratio N, in the receiver portion of a RELP vocoder, comprising the steps of:

(a) providing at least one local carrier signal, each at a frequency which is an exact integer multiple of a baseband pitch estimate frequency $f_f$ recovered from received data;

(b) amplitude modulating each of the local carrier signals with baseband residual data, recovered in the receiver portion, to provide partial spectrum data;

(c) removing, only if the decimation ratio N is even, the lower sideband data from the lowest frequency local carrier signal to obtain partial spectrum data; and (d) adding the residual baseband data to the partial spectrum data obtained in step (b), if N is odd, or step (c), if N is even, to obtain PA-HFRed output data from which to reconstruct the speech signal.

2. The method of claim 1, wherein step (a) includes the step of setting the number $n_c$ of local carrier signals to be equal to $(n-1)/2$, if N is odd, and to N/2, if N is even.

3. The method of claim 2, wherein $N=4$ and $n_c=2$.

4. The method of claim 2, wherein the speech signal has been sampled at a sample frequency $f_S$ prior to RELP data transmission to the receiver, and step (a) further comprises the steps of setting the approximate frequency $f_{a,i}$, where $1 \leqq i \leqq n_c$, of each of the local carrier signals at $f_{a,i}=(f_s/2N)(2i)$, if N is odd, and $f_{a,i}=(f_s/2N)(2i-1)$, if N is even.

5. The method of claim 4 wherein $f_S$ is on the order of 8 kHz.

6. The method of claim 5, wherein $N=4$ and $n_c=2$.

7. The method of claim 6, wherein $f_{a,1}$ is about 1 kHz. and $f_{a,2}$ is about 3 kHz.

8. The method of claim 6, wherein the two local carrier signals are provided by a single signal having a substantially square waveform at the lower frequency $f_{a,1}$.

9. The method of claim 4, wherein step (a) further includes the steps of: calculating a floor function integer $M_1$ for each local carrier; and multiplying the pitch estimate frequency $f_f$ by the associated integer $M_i$ to set the exact frequency $f_{c,i}$ of the associated carrier.

10. The method of claim 1, wherein step (b) further includes the step of lowpass filtering the residual baseband data to remove data for frequencies greater than a predetermined maximum frequency.

11. The method of claim 10, wherein the predetermined maximum frequency is substantially equal to $f_S/2N$.

12. The method of claim 11, wherein the maximum frequency is on the order of 1 kHz.

13. The method of claim 10, further comprising the steps of: upsampling the residual baseband data by the decimation factor N, prior to the lowpass filtering of the upsampled data; and subsequent using the filtered upsampled data as the baseband residual data in each of steps (b) and (d).

14. The method of claim 1, wherein step (c) includes the step of highpass filtering the partial spectrum data obtained in step (b) to remove data for frequencies less than a predetermined minimum frequency.

15. The method of claim 14, wherein the predetermined minimum frequency is substantially equal to $f_S/2N$.

16. The method of claim 15, wherein the minimum frequency is on the order of 1 kHz.

17. The method of claim 14, wherein the highpass filtering step includes the step of passing all data up to at least a frequency substantially equal to one-half the sampling frequency $f_S$.

18. The method of claim 14, wherein $N=4$, and step (a) includes the steps of: providing a single local carrier signal having a frequency of about $f_S/2N$ and a substantially square waveform with a predetermined amount of third harmonic content; calculating a floor function integer M; and setting the exact carrier signal frequency to the product of integer M and the pitch estimate frequency $f_f$; and step (c) further includes the step of compensation filtering the partial spectrum data to correct for any amplitude error of the third-harmonic content of the substantially-square waveform carrier signal.

19. The method of claim 18, wherein the compensation filtering step is carried out after the highpass filtering step.

20. The method of claim 1, wherein all steps are carried out in a single digital signal processing microcomputer.

* * * * *